US006748358B1

(12) United States Patent
Iwasaki et al.

(10) Patent No.: US 6,748,358 B1
(45) Date of Patent: Jun. 8, 2004

(54) ELECTRONIC SPEAKING DOCUMENT VIEWER, AUTHORING SYSTEM FOR CREATING AND EDITING ELECTRONIC CONTENTS TO BE REPRODUCED BY THE ELECTRONIC SPEAKING DOCUMENT VIEWER, SEMICONDUCTOR STORAGE CARD AND INFORMATION PROVIDER SERVER

(75) Inventors: Hiroshi Iwasaki, Kanagawa-ken (JP); Yoshihiro Yamazaki, Surrey (GB); Masami Akamine, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 653 days.

(21) Appl. No.: 09/678,980

(22) Filed: Oct. 4, 2000

(30) Foreign Application Priority Data

Oct. 5, 1999 (JP) ..... P11-284731

(51) Int. Cl.[7] ..... G10L 21/06
(52) U.S. Cl. ..... 704/258; 704/276
(58) Field of Search ..... 704/258, 270, 704/276

(56) References Cited

U.S. PATENT DOCUMENTS 4,653,100 A * 3/1987 Barnett et al. ..... 704/268
4,852,170 A * 7/1989 Bordeaux ..... 704/277
5,682,501 A * 10/1997 Sharman ..... 704/260
5,930,755 A * 7/1999 Cecys ..... 704/260
5,953,541 A * 9/1999 King et al. ..... 710/67
6,016,471 A * 1/2000 Kuhn et al. ..... 704/266
6,029,132 A * 2/2000 Kuhn et al. ..... 704/260
6,078,885 A * 6/2000 Beutnagel ..... 704/258
6,134,529 A * 10/2000 Rothenberg ..... 704/270
6,286,064 B1 * 9/2001 King et al. ..... 710/67
6,363,342 B2 * 3/2002 Shaw et al. ..... 704/220
6,389,386 B1 * 5/2002 Hetherington et al. ..... 704/8
6,460,015 B1 * 10/2002 Hetherington et al. ..... 704/8
6,490,563 B2 * 12/2002 Hon et al. ..... 704/260

FOREIGN PATENT DOCUMENTS

| | | |
|---|---|---|
| JP | 59-178639 | 10/1984 |
| JP | 5-289685 | 11/1993 |
| JP | 5-313684 | 11/1993 |
| JP | 6-12011 | 1/1994 |
| JP | 6-337774 | 12/1994 |
| JP | 7-191686 | 7/1995 |

* cited by examiner

*Primary Examiner*—Doris H. To
*Assistant Examiner*—Michael N. Opsasnick
(74) *Attorney, Agent, or Firm*—Finnegan, Henderson, Farabow, Garrett & Dunner, L.L.P.

(57) ABSTRACT

An improved electronic speaking document viewer is provided in order that a user can readily use electronic texts in the same manner as reading text images printed on paper. The electronic speaking document viewer accommodates a semiconductor storage card in the form of a detachable card type storage medium and includes a speech synthesis unit for performing speech synthesis on the basis of the intermediate language data stored in the semiconductor storage card, and a synthesized speech outputting unit for outputting the synthesized speech as synthesized by means of said speech synthesis unit. In accordance with the present embodiment, a high quality of synthesized speech is accomplished by the use of the intermediate language data S. The electronic speaking document viewer further comprises a text data display unit for displaying the text data consisting of letters in synchronism with the synthesized speech.

11 Claims, 8 Drawing Sheets

ELECTRONIC SPEAKING DOCUMENT VIEWER, AUTHORING SYSTEM FOR CREATING AND EDITING ELECTRONIC CONTENTS TO BE REPRODUCED BY THE ELECTRONIC SPEAKING DOCUMENT VIEWER, SEMICONDUCTOR STORAGE CARD AND INFORMATION PROVIDER SERVER

CROSS REFERENCE TO THE RELATED APPLICATION

The subject application is related to subject matter disclosed in the Japanese Patent Application No.Heill-284731 filed in Oct. 5, 1999 in Japan, to which the subject application claims priority under the Paris Convention and which is incorporated by reference herein.

BACKGROUND OF THE INVENTION

1. Field of the Invention

The present invention is related to an improved electronic speaking document viewer, an authoring system for creating and editing electronic contents to be reproduced by the electronic speaking document viewer, a semiconductor storage card and an information provider server. The electronic speaking document viewer serves to convert text to speech sounds in accordance with the text data as contained in a semiconductor storage card inserted to the electronic speaking document viewer.

2. Prior Art

The text culture has been supported by printed matters on paper to be viewed with naked eyes for long years. However, there have come electronic document viewers such as the e-BOOK (commercial name) broadly distributed in U.S.A.

The electronic document viewer of this kind serves to simply provide typographic images on a character display of the electronic document viewer. The typographic images are reproduced from a storage medium such as the memory space of the electronic document viewer or an external portable storage in which text data is stored in the form of character codes or typographic graphic images.

On the other hand, there are practical applications for providing speech from an electronic book package in the form of storage mediums such as cassette tapes, compact discs and so forth through an appropriate electronic speaking device.

However, in the case of the exemplary prior art technique as explained above, there are following shortcomings as described below.

(1) It is inevitable to cause the user's inconvenience and discomfort when he continues reading through an electronic document viewer for a long time because the typographic images as reproduced on the character display of the electronic document viewer is substantially poorer as compared with letters printed on paper, causing eyestrain, and can not be readily used in his life. In some cases, clear text images printed on paper are directly digitized as still image data for the purpose of increasing the resolution. In this case, however, there are shortcomings that the readily use of the electronic document viewer becomes furthermore difficult and can not be easily put into practice since the resolution of the character display and the available memory space have to be increased.

(2) The field of the electronic book packages is recognized as belonging to another category, such as radio plays, different than the text culture in which are read letters printed on paper, and therefore the electronic book packages are not such as competing with or replacing the text culture based upon printed matters on paper. On the other hand, if raw speech is stored in a storage medium, the data size as required is significantly increased as greatly larger than the data size of the corresponding text data. Because of this, the amount of information available in the form of raw speech data is significantly limited as compared with the amount of information given form text images printed on paper so that it seems not practicable as considered from the text culture allowing the readily use of books.

SUMMARY OF THE INVENTION

In brief, the above and other objects and advantages of the present invention are provided by a new and improved electronic speaking document viewer accommodating a semiconductor storage card in the form of a detachable card type storage medium in which text data consisting of letters and intermediate language data indicative of the rules of how to phonetically read said text data, said electronic speaking document viewer comprising:

- a text data display unit for displaying the text data consisting of letters stored in said semiconductor storage card;
- a speech synthesis unit for performing speech synthesis on the basis of the intermediate language data stored in said semiconductor storage card;
- a synthesized speech outputting unit for outputting the synthesized speech as synthesized by means of said speech synthesis unit; and
- a control unit for synchronizing said text data display unit and said synthesized speech outputting unit with each other.

In a preferred embodiment, further improvement resides in that said text data comprises image data and said intermediate language data is generated from typographic data contained in said text data to indicate the rules of how to phonetically read the typographic data.

In a preferred embodiment, further improvement resides in that the phonogramic data of said intermediate language data consists of katakana character strings.

In a preferred embodiment, further improvement resides in that said intermediate language data includes synchronization codes for synchronizing said text data display unit and said synthesized speech outputting unit with each other; and wherein said control unit serves to synchronize said text data display unit and said synthesized speech outputting unit with each other on the basis of the synchronization codes.

In accordance with a further aspect of the present invention, the above and other objects and advantages of the present invention are provided by a new and improved electronic speaking document viewer accommodating a semiconductor storage card in the form of a detachable card type storage medium in which unencrypted text data consisting of letters and encrypted intermediate language data indicative of the rules of how to phonetically read said text data, said electronic speaking document viewer comprising:

- a text data display unit for displaying the text data consisting of letters stored in said semiconductor storage card;
- a decryption unit for decrypting the encrypted intermediate language data contained in said semiconductor storage card;
- a speech synthesis unit for performing speech synthesis on the basis of the intermediate language data as decrypted by means of said decryption unit; and a synthesized speech outputting unit for outputting the synthesized speech as synthesized by means of said speech synthesis unit.

In accordance with a further aspect of the present invention, the above and other objects and advantages of the present invention are provided by a new and improved electronic speaking document viewer accommodating a semiconductor storage card in the form of a detachable card type storage medium in which encrypted text data consisting of letters and encrypted intermediate language data indicative of the rules of how to phonetically read said text data, said electronic speaking document viewer comprising:

a decryption unit for decrypting the encrypted text data and the encrypted intermediate language data contained in said semiconductor storage card;

a text data display unit for displaying the text data consisting of letters stored in said semiconductor storage card and decrypted by means of said decryption unit;

a speech synthesis unit for performing speech synthesis on the basis of the intermediate language data as decrypted by means of said decryption unit; and a synthesized speech outputting unit for outputting the synthesized speech as synthesized by means of said speech synthesis unit.

In a preferred embodiment, further improvement resides in that signals indicative of forwarding and rewinding are detected; wherein when the signal indicative of forwarding is detected during the period in which said electronic speaking document viewer is outputting the synthesized speech, the sentence to be reproduced with synthesized speech is determined in accordance with the repeat count of the forwarding signal in order to forward to the top of a sentence after the current sentence and to perform the speech synthesis; and wherein when the signal indicative of rewinding is detected during the period in which said electronic speaking document viewer is outputting the synthesized speech, the sentence to be reproduced with synthesized speech is determined in accordance with the repeat count of the rewinding signal in order to back to the top of a sentence preceding the current sentence and to perform the speech synthesis.

In a preferred embodiment, further improvement resides in that, when a signal indicative of indexing is detected during the period in which said electronic speaking document viewer is outputting the synthesized speech, an index is inserted to said text data and said intermediate language data at the location which is just phonetically reproduced when the indexing signal is detected and wherein, when a signal indicative of reproducing the indexed portion of said text data and said intermediate language data, the corresponding indexed data is reproduced.

In a preferred embodiment, further improvement resides in that when the signal indicative of reproducing the indexed portion is detected, said text data as indexed is displayed by said text data display unit while the speech synthesis is conducted by said speech synthesis unit with the intermediate language data corresponding to said text data as indexed.

In accordance with a further aspect of the present invention, the above and other objects and advantages of the present invention are provided by a new and improved authoring system for an electronic speaking document viewer comprising:

a language parser unit for performing language parsing process with text data consisting of character codes in order to generate intermediate language data corresponding to the rules of how to phonetically read the text data.

In a preferred embodiment, further improvement resides in that the encryption unit is provided for encrypting the intermediate language data generated from said language parser unit or said proof correction unit.

In accordance with a further aspect of the present invention, the above and other objects and advantages of the present invention are provided by a new and improved semiconductor storage card comprising:

a non-volatile memory for storing unencrypted text data based on which typographic images is displayed by means of a typographic images displaying unit of an electronic viewer and for storing encrypted intermediate language data indicative of the rules of how to phonetically read the text content data, wherein speech synthesis is performed by means of a speech synthesis unit of the electronic viewer with reference to said unencrypted text data and said encrypted intermediate language data; and a thin case for supporting said non-volatile memory.

In a preferred embodiment, further improvement resides in that said non-volatile memory comprising:

a first storage region for storing said text data;

a second storage region for storing said intermediate language data; and a third read only storage region for storing an ID number for identifying the semiconductor storage card itself, wherein said intermediate language data is encrypted by the use of the ID number.

In accordance with a further aspect of the present invention, the above and other objects and advantages of the present invention are provided by a new and improved information provider server comprising:

an information database for storing text data consisting of letters and intermediate language data indicative of the rules of how to phonetically read said text data in the form of uncrypted plain data; and an information provider server connected to said information database, wherein said information provider server contains an encryption program, receives a request for said text data and said intermediate language data together with data for use in encryption through a network, encrypts said intermediate language data by the use of said data for use in encryption and sends a response accompanied with said intermediate language data as encrypted together with said text data through said network.

It will be desired to prevent the encrypted intermediate language data from being pirated for example by making use of the ID number of the storage medium such as said semiconductor storage card as data or part of data used for generating said encryption key by means of an encryption program in said information provider server.

In a preferred embodiment, further improvement resides in that said text data is also encrypted by the use of said data for use in encryption and wherein said information provider server sends a response accompanied with said intermediate language data as encrypted together with said text data through said network.

In a preferred embodiment, further improvement resides in that said data for use in encryption is an ID number of a semiconductor storage card in the form of a detachable card type storage medium in which said text data consisting of letters and said intermediate language data indicative of the rules of how to phonetically read said text data, and said data for use in encryption is used to generate an encryption key.

In a preferred embodiment, further improvement resides in that said text data and said intermediate language data is such as decrypted and reproduced by an electronic speaking document viewer accommodating said semiconductor storage card, said electronic speaking document viewer comprising:

a text data display unit for displaying the text data consisting of letters stored in said semiconductor storage card;

a speech synthesis unit for performing speech synthesis on the basis of the intermediate language data stored in said semiconductor storage card;

a synthesized speech outputting unit for outputting the synthesized speech as synthesized by means of said speech synthesis unit; and a control unit for synchronizing said text data display unit and said synthesized speech outputting unit with each other.

BRIEF DESCRIPTION OF DRAWINGS

The novel features believed characteristic of the invention are set forth in the appended claims. The invention itself, however, as well as other features and advantages thereof, will be best understood by reference to the detailed description of specific embodiments which follows, when read in conjunction with the accompanying drawings, wherein:

DETAILED DESCRIPTION OF EMBODIMENTS

Several examples of preferred embodiments of the present invention will be explained in details with reference to the drawings in the followings.

[First Embodiment]

The electronic speaking document viewer in accordance with the present invention does not resort a conventional speech synthesis system which serves to generate speech data by directly converting text content data D consisting of character codes. The speech synthesis in accordance with the present invention serves to convert the text content data with reference to intermediate language data which is provided corresponding to the text content data and which is indicative of the rules of how to phonetically read the text content data. The intermediate language data is stored in the semiconductor storage card together with the text content data in order that the speech synthesis is performed on the basis of the intermediate language data.

In this case, the intermediate language data S is introduced to represent a phonogramic stream, for example, consisting of (1) a katakana character string as phonogramic data, (2) control codes indicative of accents and (3) control codes indicative of pauses. Furthermore, the intermediate language data S may includes synchronization codes which are necessary when the text content data D consisting of character codes is reproduced in synchronism with the corresponding speech.

Figure 1:
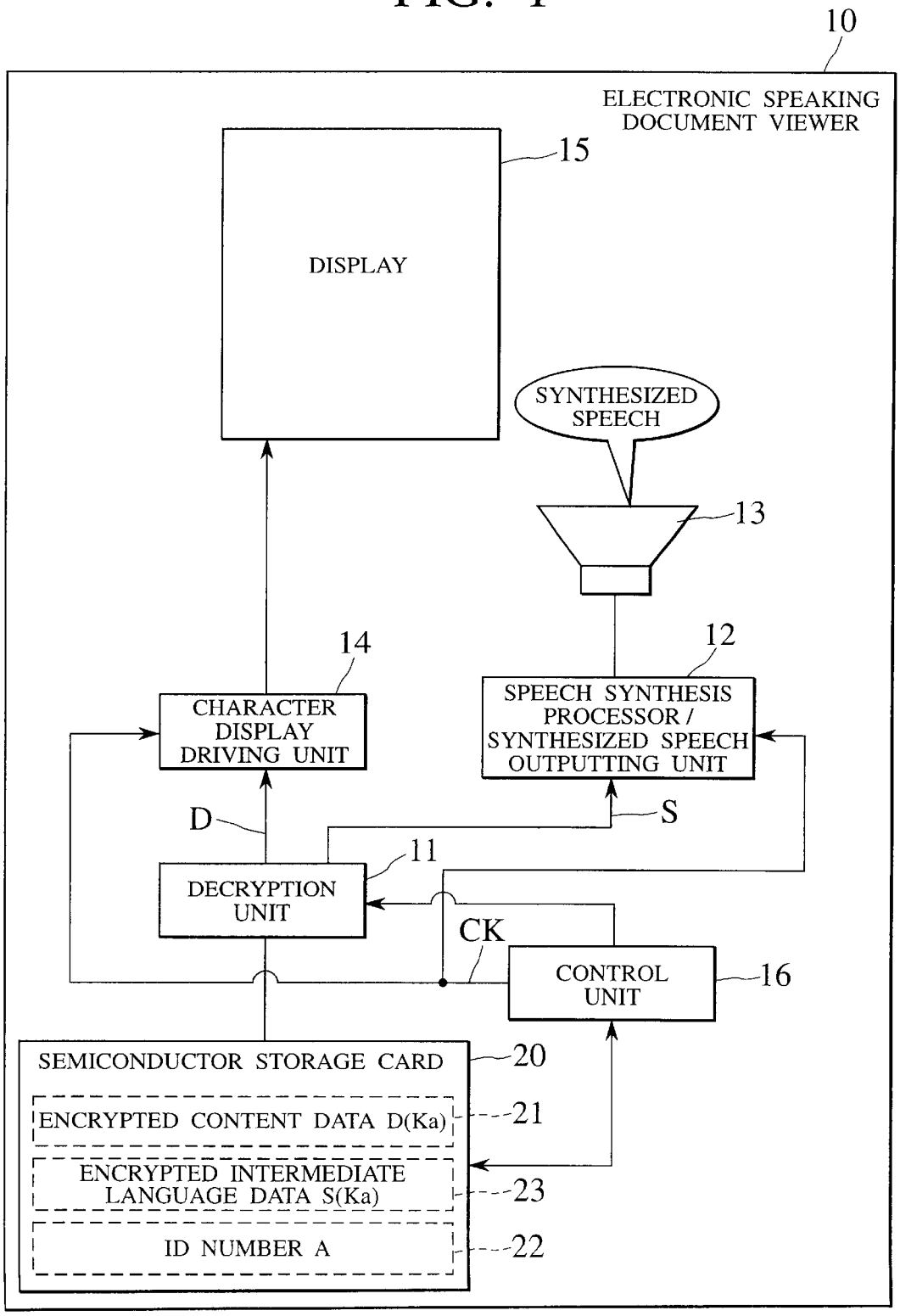
FIG. 1 is a block diagram showing the major portions of the electronic speaking document viewer in accordance with a first embodiment of the present invention.

FIG. 1 is a block diagram showing the major portions of the electronic speaking document viewer in accordance with the first embodiment of the present invention.

The electronic speaking document viewer body 10 is designed in the form of a portable device which accommodates a semiconductor storage card 20 removably inserted as a card type storage medium. Furthermore, the electronic speaking document viewer body 10 is equipped with electronic circuitry consisting of a decryption unit 11, a speech synthesis processor/synthesized speech outputting unit 12, a loudspeaker (or earphone) 13, a character display driving unit 14, a liquid crystal panel 15 and a control unit 16. The control unit 16 is composed of, for example, a microprocessor and serves to control the reading operation of data stored in the semiconductor storage card 20, the timing adjustment of the respective operations of the constituent units and other operations relative to the entire cooperation. Also, not shown in the figure, there are provided several manipulating buttons as a user interface for inputting and a variety of instructions and associated interface circuits therewith. The constituent units as described heretofore are driven at least with a built-in battery.

On the other hand, the semiconductor storage card 20 is composed of a non-volatile memory chip and a case (with its outer dimensions of 37 mm×45 mm×0.76 mm) which can be assembled in the form of a thin card and accommodating the non-volatile memory. The text content data D in the form of character codes is encrypted as encrypted content data D(ka) and stored in a storage region 21 of the non-volatile memory. Also, a storage region 23 is used to store the encrypted intermediate language data S(ka) by encrypting the intermediate language data S which is prepared corresponding to said text content data D and indicative of the rules of how to phonetically read the text content data.

The semiconductor storage card 20 is inserted to the electronic speaking document viewer body 10 which can be driven to reproduce the encrypted content data D(ka) and the encrypted intermediate language data S(ka).

Namely, the encrypted content data D(ka) and the encrypted intermediate language data S(ka) as read from the semiconductor storage card 20 is decrypted by means of the decryption unit 11 to provide the text content data D as a plain data. The speech synthesis processor/synthesized speech outputting unit 12 serves to receive the text content data D as decrypted and perform the speech synthesis of the text content data D with reference to the intermediate language data S followed by the operation of the loudspeaker (or earphone) 13. The synthesized speech is then output from the loudspeaker (or earphone) 13 corresponding to the text data D of the title.

On the other hand, the text content data D as decrypted is supplied to the character display driving unit 14, which serves to drive the liquid crystal panel 15 to visualize the text content data D.

In this case, the control unit 16 serves to output the timing clock signal CK both the character display driving unit 14 and the speech synthesis processor/synthesized speech outputting unit 12 for the purpose of synchronization therebetween in order to display anew the typographic images on the character display 15 in correspondence with the synthesized speech as being output.

More specifically speaking, the typographic images are provided on the liquid crystal panel 15 as one of the respective individual pages of the contents or as each predetermined number of characters in synchronism with the synthesized speech as being output. Furthermore, the synchronization between the typographic images on the character display and the synthesized speech is performed, for example, in order that the typographic images of the page as displayed is updated with the next page each time the output of the synthesized speech of the current page is completed.

Next, the encryption system and the decryption system in accordance with the present invention will be explained.

In the copyright protection schema, the storage region 21 of the semiconductor storage card 20 in accordance with the present invention serves to store the encrypted content data D(ka) while the storage region 23 serves to store the encrypted intermediate language data S(ka).

Figure 2:
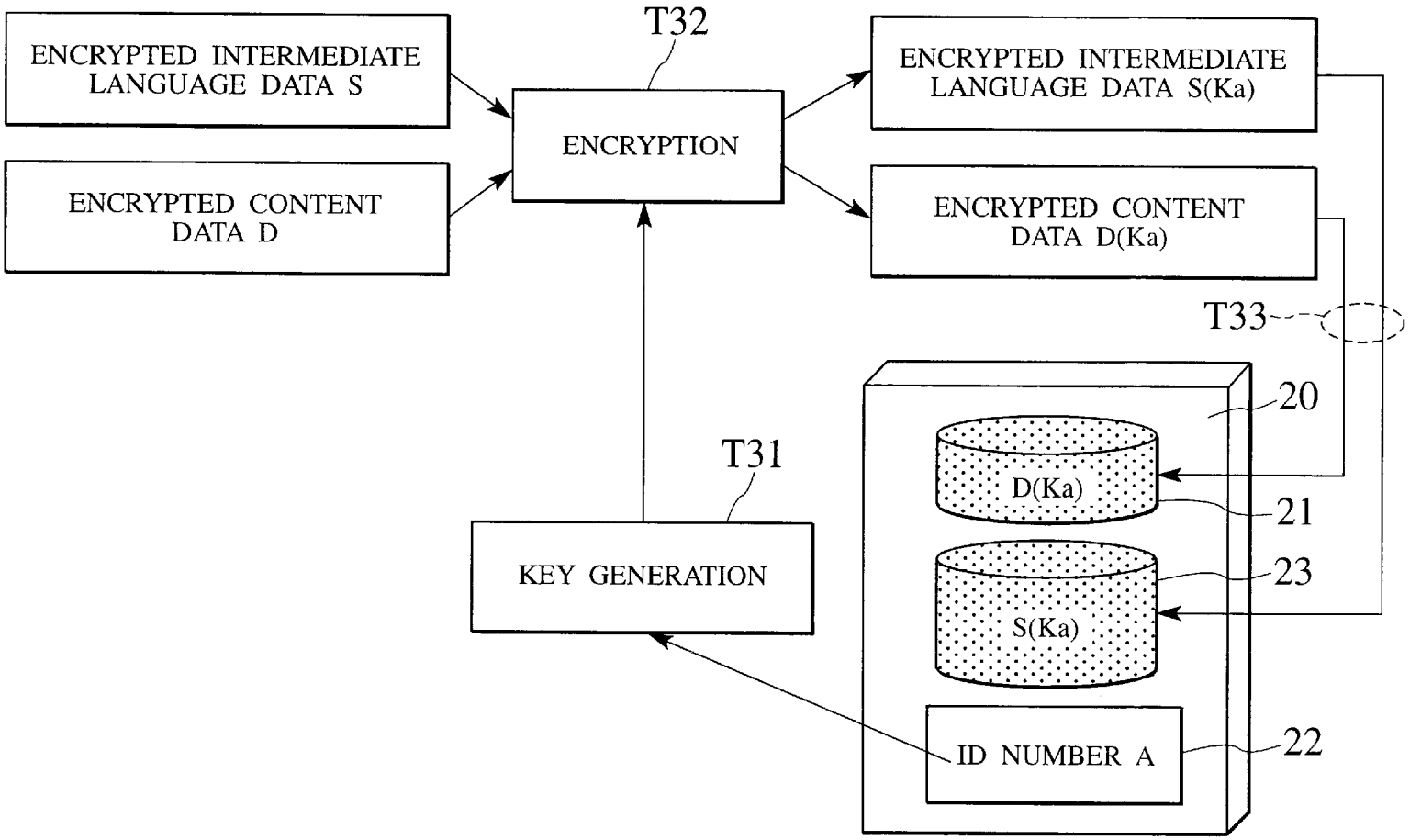
FIG. 2 is a schematic diagram showing one example of the encryption system in accordance with the first embodiment of the present invention.
Figure 8:
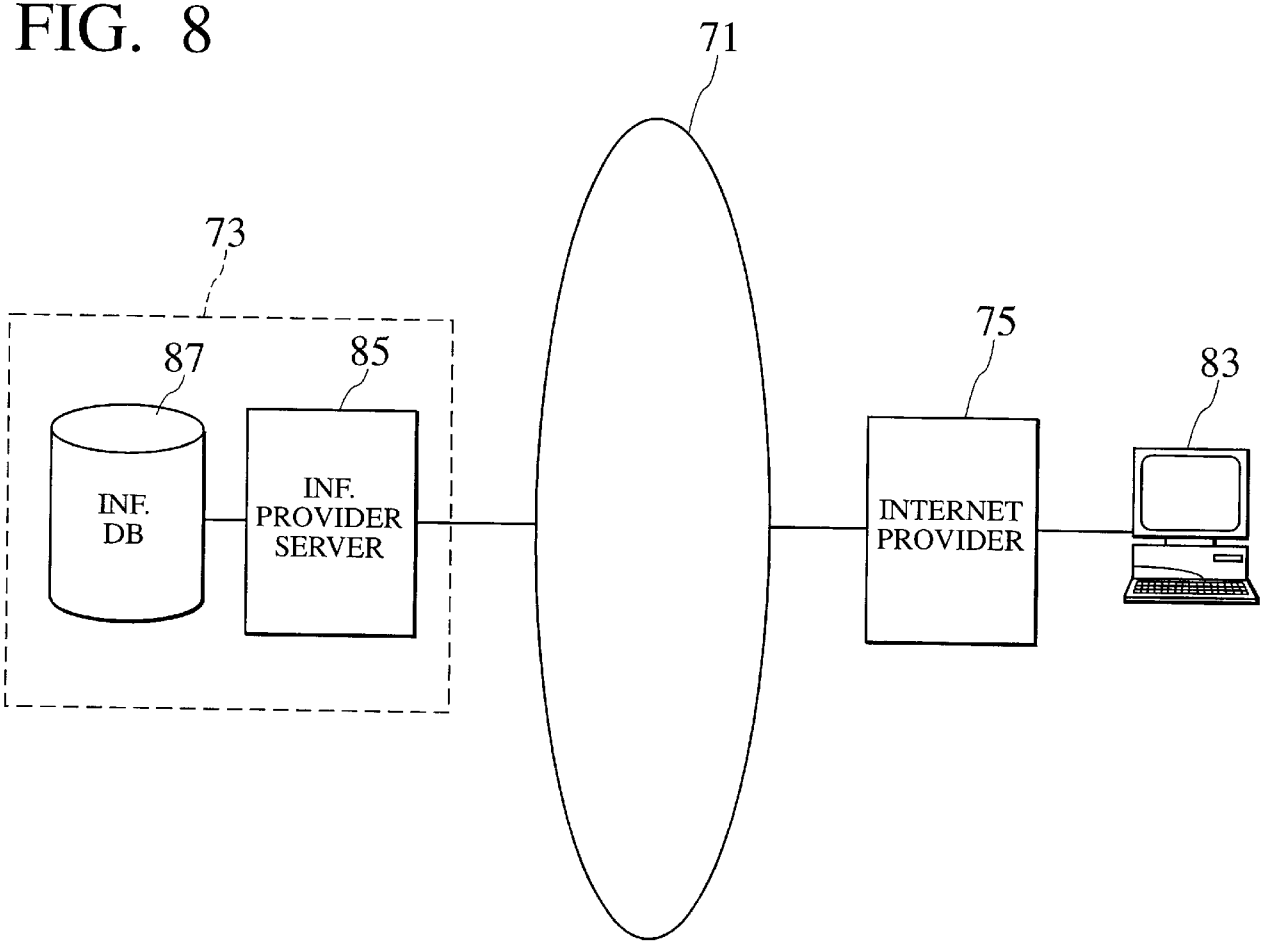
FIG. 8 is a block diagram showing an exemplary service provider system serving to provide contents for use in the electronic speaking document viewer for converting text to speech sounds in accordance with a fourth embodiment of the present invention.

FIG. 2 is a schematic diagram showing one example of the encryption system in accordance with the present embodiment. The encryption system is implemented in the authoring system (as illustrated in FIG. 8 and will be explained later) as an encryption unit for the electronic speaking document viewer.

As illustrated in FIG. 2, the semiconductor storage card 20 is provided with a read only storage region 22 for storing an ID number A (which is an identification number, unique to that semiconductor storage card) in addition to the storage region 21 for storing the encrypted content data D(ka) and the storage region 23 for storing the encrypted intermediate language data S(ka).

First, the ID number A is read from the semiconductor storage card 20 and used as a key or part of a key for generating the encryption key (ka) (T31 in FIG. 2). The original text content data D and the original intermediate language data S is then encrypted with the encryption key (ka) (T32 in FIG. 2) in order to provide the encrypted content data D(ka) and the encrypted intermediate language data S(ka). The encrypted content data D(ka) and the encrypted intermediate language data S(ka) is stored in the storage region 21 and the storage region 23 respectively (T33 in FIG. 2).

The procedure of reproducing the encrypted content data D(ka) and the encrypted intermediate language data S(ka) as stored in the semiconductor storage card 20 in this manner will be explained with reference to FIG. 3.

Figure 3:
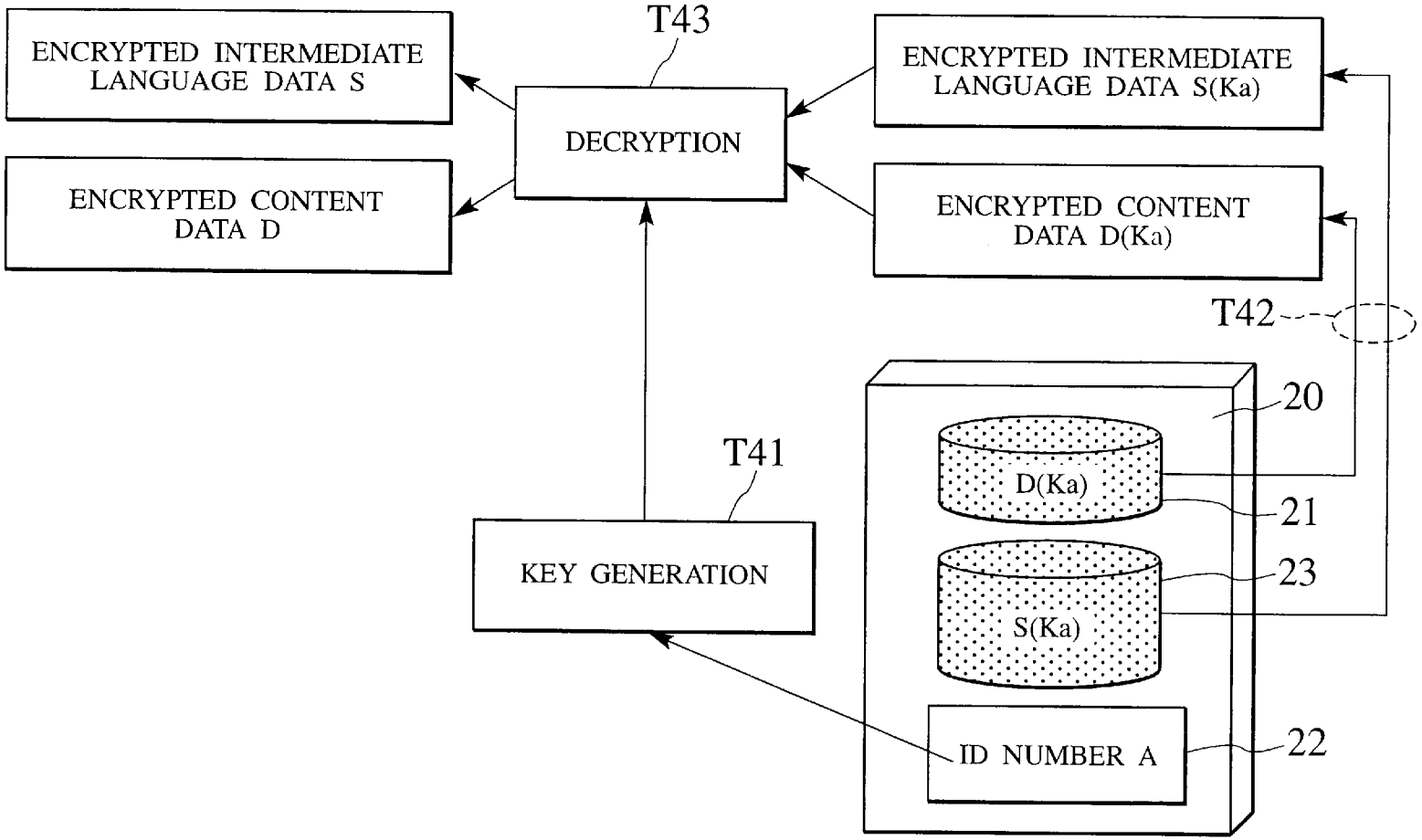
FIG. 3 is a schematic diagram showing one example of the decryption system in accordance with the first embodiment of the present invention.

FIG. 3 is a schematic diagram showing one example of the decryption system in accordance with the present embodiment.

The control unit 16 serves to read the ID number A of the semiconductor storage card 20 which has been inserted to the electronic speaking document viewer body 10. The decryption key (ka) (equivalent to the encryption key (ka)) is then generated with the ID number A as a key or part of a key (T41 in FIG. 2). The decryption unit 11 then serves to decrypt the encrypted content data D(ka) and the encrypted intermediate language data S(ka) with the decryption key (ka) (T43 in FIG. 3) in order to reproduce the original text content data D and the original intermediate language data S.

Suppose for example that the encrypted content data D(ka) and the encrypted intermediate language data S(ka) corresponding to the ID number A is pirated and copied to the semiconductor storage card with an ID number B. In this case, however, since an ID number B different than the ID number A is assigned to his semiconductor storage card, the encrypted contents data D(ka) and the encrypted intermediate language data S(ka) can not be decrypted with the decryption key (kb) and therefore it is impossible to reproduce the encrypted contents from his semiconductor storage card through the electronic speaking document viewer. As explained heretofore, the electronic speaking document viewer serves to reproduce data only when the semiconductor storage card with the ID number B is storing the encrypted contents data D(kb) and the encrypted intermediate language data S(kb) as correspondingly encrypted with the ID number B.

Furthermore, it is possible to make compact and light-weight the electronic speaking document viewer body 10 not only because the semiconductor storage card itself is compact and light-weight but also because there is no need for mechanical parts in the electronic speaking document viewer for driving the semiconductor storage card unlike magnetic disks, optical disks and the like. By virtue of the electronic speaking document viewer in accordance with the present embodiment, the user can trace the respective letters in the typographic images on the liquid crystal panel 15 while hearing the synthesized speech with an earphone and so forth. It is therefore possible to facilitate the comprehension of the contents as compared to the case only with the synthesized speech and without the typographic images and vice versa.

Furthermore, in the case of the electronic speaking document viewer in accordance with the present embodiment, it is possible to use the electronic speaking document viewer, depending upon the place and the user's preference, as a simple audio player with an earphone only for listening the synthesized speech without the typographic images, for example, when walking around, sitting on public transport etc., and alternatively as a simple text viewer without speech to read a text like a book.

Next, the advantages of the present embodiment will be explained in details.

(1) When the synthesized speech is generated by synthesizing only from the text content data D consisting of character codes, it is impossible to generate correct speech with an accuracy of 100%. Contrary to this, in accordance with the present embodiment, a high quality of synthesized speech is accomplished by the use of the intermediate language data S.

Generally speaking, it is inevitable to perform the phonetic parsing process, i.e., for extracting the rules of how to phonetically read the text content data with intonations and accents, articulation and so forth from the text content data in advance of the actual speech synthesis. However, the phonetic parsing process tends to require a large dictionary for learning the analysis so that it is difficult in the current technique to implement the technique within a compact and light weight electronic speaking document viewer at a low cost. In addition to this, if a phonetic parsing process is implemented within a portable machine, quick response can no longer be expected while the power consumption is substantially increased to quickly use up the battery because a significant burden is placed on the arithmetic operation unit of the portable machine.

In accordance with the present invention, since the phonetic parsing process has been completed to store the intermediate language data S in the semiconductor storage card 20 (as explained in the followings with reference to FIG. 7), the electronic speaking document viewer body 30 need no longer perform the phonetic parsing process while the size of the intermediate language data S is only in the order of about 1.5 times that of the original text content data D. It is possible to realize a compact and light weight electronic speaking document viewer at a reasonable low cost.

(2) It is possible to display the typographic images on the liquid crystal panel 15 in synchronism with the synthesized speech by reversing the process of parsing the respective passages of the text data to the intermediate language data in order to obtain typographic images from the intermediate language data. In this case, however, a significant burden is placed on the arithmetic operation unit of the electronic speaking document viewer body 30 as described heretofore.

In order to solve the shortcomings, in the case of the present embodiment, the intermediate language data is stored in the semiconductor storage card together with the text data consisting of character codes, which are used for displaying typographic images on the character display 15. By this configuration, it is therefore possible to realize a portable electronic speaking document viewer at a low cost.

In this case, the value-added data is the intermediate language data, the text content data D is not necessarily encrypted in order to avoid ineffective complexity, to realize a compact and light weight electronic speaking document viewer at a low cost and to save the electric power consumption of the electronic speaking document viewer.

(3) The text data consisting of character codes and the intermediate language data is stored the semiconductor storage card 20 in accordance with the present embodiment so that a large amount of information can be stored in a relatively small memory area as compared with the case of storing raw speech data.

Meanwhile, while the electronic speaking document viewer body 10 is provided with the liquid crystal panel 15 as illustrated in FIG. 1, a separate character display 15 can be connected to the electronic speaking document viewer body 10 when used. The character display 15 and the electronic speaking document viewer body 10 may be arranged in the form of two facing pages of a book in order to provide an analogous style with a real book.

The typographic images are displayed on the character display 15 in synchronism with the synthesized speech for each page as explained heretofore. Alternatively, it is possible to perform synchronization in a one-to-one correspondence to emphasize the word being currently pronounced in the synthesized speech.

Furthermore, it is possible to delete the process of encrypting the text content data D. In this case, the decryption unit 11 of the electronic speaking document viewer body 10 can be dispensed with.

Figure 5:
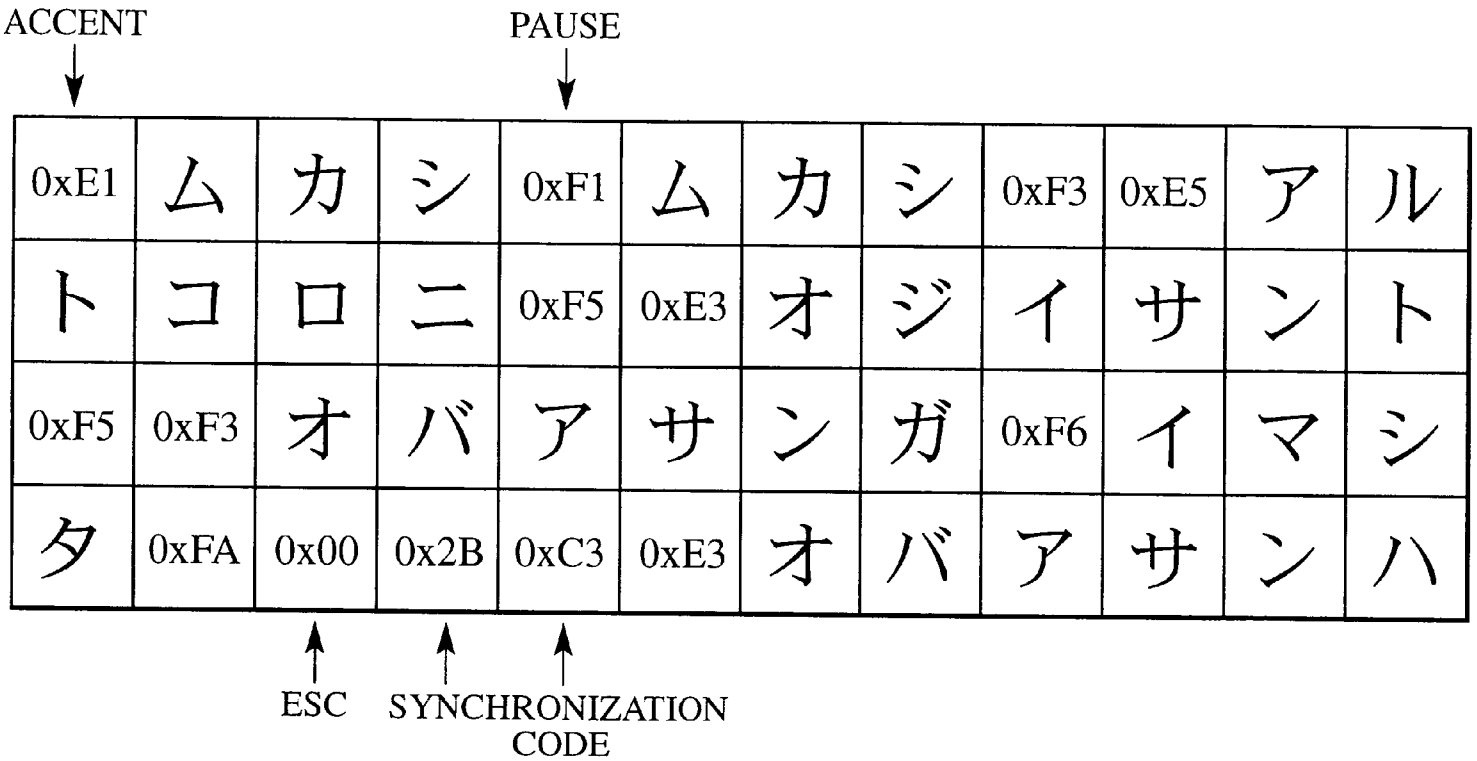
FIG. 5 is a schematic view showing an example of the intermediate language data S for use in the electronic speaking document viewer in accordance with the present invention.

FIG. 5 is a schematic view showing an example of the intermediate language data S for use in the electronic speaking document viewer of the present embodiment. In this case, as described heretofore, the intermediate language data S consists of (1) a katakana character string as phonogramic data, (2) control codes indicative of accents and (3) control codes indicative of pauses. The katakana character string is a sequence of one-byte codes. For example, shift-JIS codes, i.e., 0xA6 to 0xDD can be used. However, some codes such as "ヲ" should not be used in order to establish a one-to-one correspondence of the respective code to the pronunciation sounds. For the same reason, for example, a Japanese postpositional particle "ハ" should be "ワ". The control codes indicative of accents and pauses and flags indicative of synchronization timing are represented by the remaining one-byte codes.

For example, accents of 16 types are represented by one-byte codes of 0xE0 to 0xEF while pauses of 16 lengths are represented by one-byte codes of 0xF0 to 0xFF. On the other hand, an escape sequence of 0x0000 is used for indicating the subsequent 16 bits as a synchronization code. Alternatively, an escape sequence of 0x00 is used for indicating the subsequent 24 bits as a synchronization code.

One of another simple example, when a pause of a predetermined length or a longer pause is found, the control code thereof is recognized as an escape sequence to be followed by the subsequent 24 bits as a synchronization code.

Also, in accordance with a further simple example, an escape sequence such as 0x00 may be inserted as a lone flag to dispense with a subsequent synchronization code. Alternatively, for the same purpose, when a pause of a predetermined length or a longer length is found, such a control code is recognized as an escape sequence without a subsequent synchronization code.

In the case of the most simplified case, the electronic speaking document viewer is capable of viewing only the typographic images of the respective individual pages. In this case, the speech is continued to the last full stop (or the last punctuation mark) of the current page being displayed. The escape sequence is therefore inserted into the position of the katakana character string corresponding to the last full stop (or the last punctuation mark). When the speech reaches the escape sequence, the speech breaks for a longer pause while turning the page to display the next page. In this case, however, the next page starts from the position just after the last full stop (or the last punctuation mark) of the previous page.

In the case that the escape sequence of 0x0000 is used for indicating the subsequent 16 bits as a synchronization code or the case that the escape sequence of 0x00 is used for indicating the subsequent 24 bits as a synchronization code, the control is simplified by inserting the corresponding page number after the escape sequence.

If the electronic speaking document viewer is designed to be capable of scrolling the display, the escape sequence is inserted to all the positions of the katakana character string corresponding to the respective full stops (or the respective punctuation marks) of each page. In this case, the serial number of the escape sequence inserted corresponding to the last full stop (or the last punctuation mark) of the page as displayed is latched to an appropriate memory location or a appropriate register. When the speech reaches the escape sequence of the number as latched, the speech breaks for a longer pause while turning the page to display the next page. For example, the number of the escape sequence is the serial number as counted from the first escape sequence.

Next, the memory area required for the semiconductor storage card 20 of the electronic speaking document viewer in accordance with the present embodiment will be calculated. Assuming that one average separate book consists of 250 pages each of which consists of 700 letters, one title can be estimated to have 175,000 letters. When each letter is represented by a 2-byte code, the memory area as required is 350,000 bytes and therefore the text of one average separate book occupies 0.35 MB in the semiconductor storage card.

Since the memory area as required for storing the text content data D together with the intermediate language data S is about 2.5 times the memory area as required for storing only the text content data D, all the data can be stored in the semiconductor storage card of about 1 MB even considering the marginal space of the data.

Contrary to this, assuming that one page consists of 700 letters, it takes about 2 minutes to phonetically output one page so that it takes about 500 minutes to read one average separate book consisting of 250 pages. Even if the compression mode of 16 kbps is employed at the expense of the sound quality, the semiconductor storage card has to be of about 64 MB.

These memory areas are different from each other by a factor of 80 to 70 so that it is apparent that the electronic speaking document viewer in accordance with the present invention is advantageous to save a large amount of data in a relatively small memory area. This makes it possible to sufficiently reduce the distribution cost of the text data contained in the semiconductor storage card, entering in rivalry with the text culture based on printed matters.

Meanwhile, the text content data D is stored in the semiconductor storage card 20 as the encrypted content data D(ka) in the case of the present embodiment as explained heretofore. However, it is possible to store the plain text without encryption. In this case, the text content data D is output directly to the character display driving unit 14A without the encryption process and the decryption process.

When funny pictures, cartoons, comic strips with dramatic stories are treated, in accordance with a modification of the present embodiment, the content data D is composed of the image data D and therefore the intermediate language data S is generated as the rules of how to phonetically read the text data as extracted from the typographic images contained in funny pictures, cartoons, comic strips with dramatic stories.

The image data occupies 5 times the memory area required for text based contents in the semiconductor storage card 20. It is possible to apply the present invention for the field such as the typographic images contained in funny pictures, cartoons, comic strips with dramatic stories.

In this case, the image data is provided on the liquid crystal panel 15 as one of the respective individual pages of the contents in synchronism with the synthesized speech as being output. The image data D can be encrypted as explained heretofore.

The use of image data is applicable for any text data provided in the form of typographic images. The character codes as contained in the text data can be converted to the corresponding clear typographic images part of which may be expanded or part of which may include letters with an extraordinary appearance. It is possible to provide a variety of expressions of typographic images.

[Second Embodiment]

In the case of the second embodiment of the present invention, the forwarding/rewinding function and the indexing function are introduced in order to improve the usability of the electronic speaking document viewer of the first embodiment of the present invention.

Figure 4:
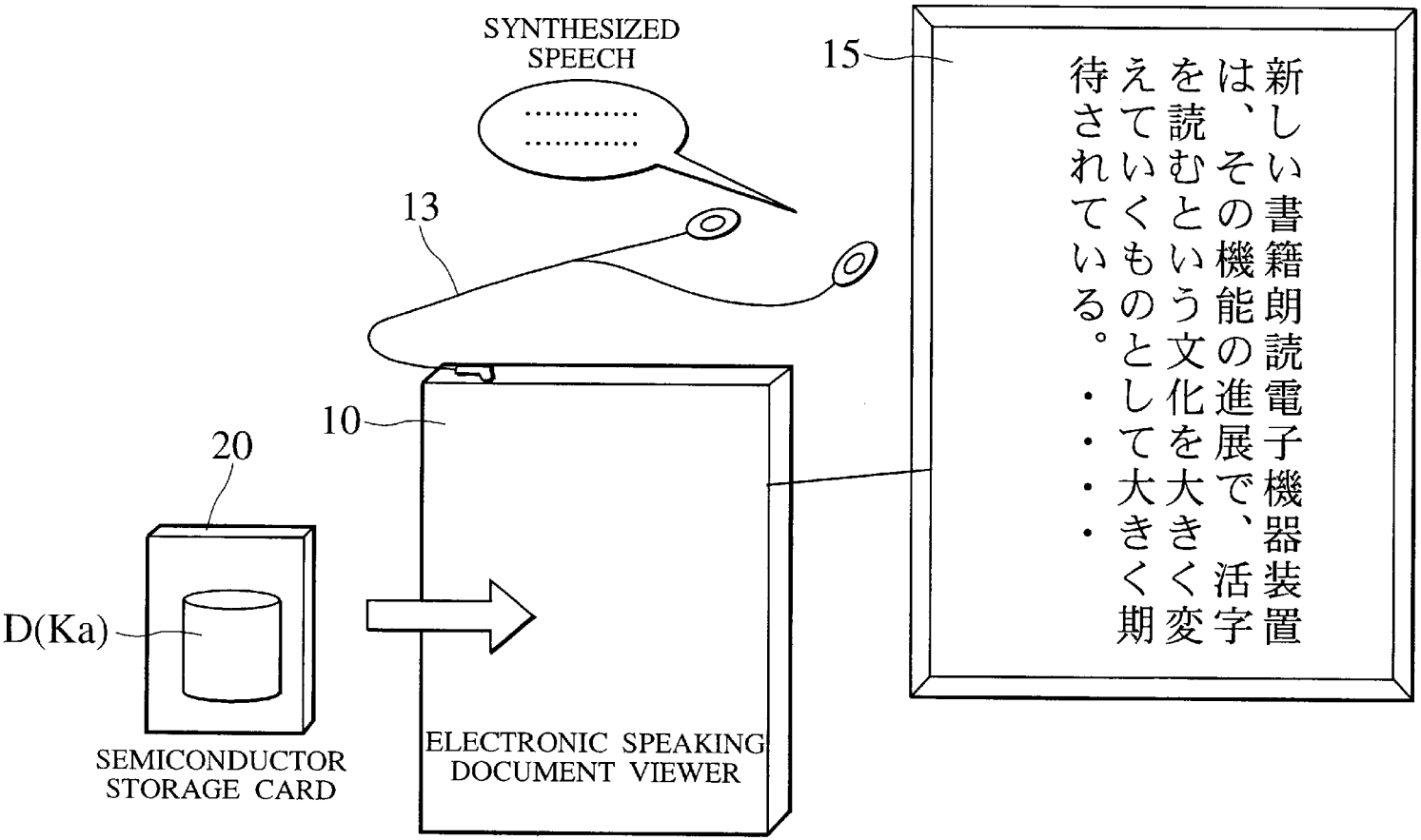
FIG. 4 is a schematic view for illustrating the electronic speaking document viewer to which a separate character display is connected.
Figure 6:
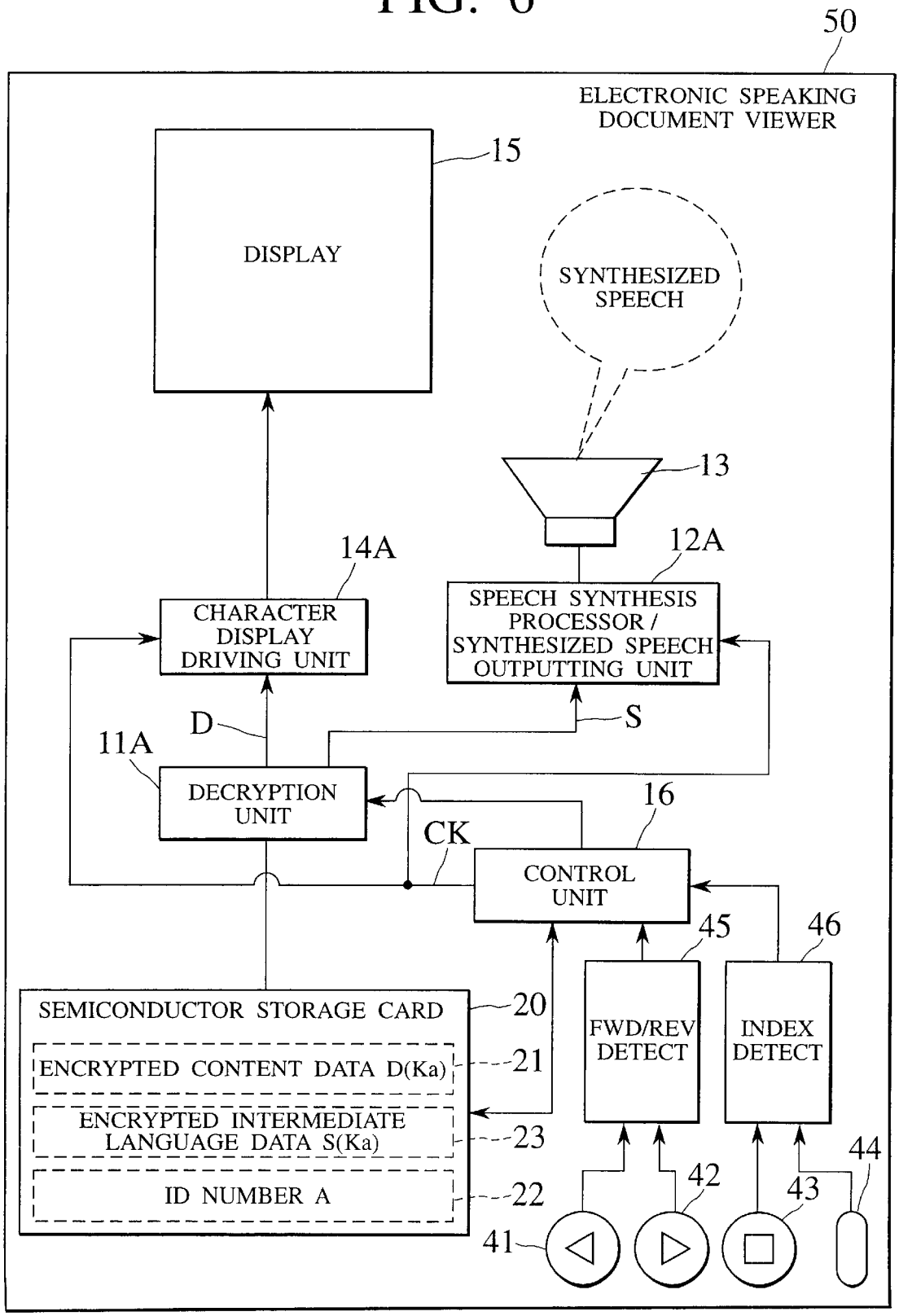
FIG. 6 is a block diagram showing the major portions of the electronic speaking document viewer in accordance with a second embodiment of the present invention.

FIG. 6 is a block diagram showing the major portions of the electronic speaking document viewer in accordance with a second embodiment of the present invention. Similar references are given to similar elements of FIG. 6 as in FIG. 4.

As illustrated in FIG. 6, in the case of the electronic speaking document viewer 50 in accordance with the present embodiment, the forwarding/rewinding function and the indexing function are introduced to the configuration as illustrated in FIG. 1. Namely, the electronic speaking document viewer 50 is provided with a rewinding button 41, a forwarding button 42, an indexing button 43 and an index reproducing button 44. The electronic speaking document viewer 50 is further provided with a forwarding/rewinding detection circuit 45 for detecting the action of pushing down the rewinding button 41 or the forwarding button 42 and an indexing detection circuit 46. The detection signal from the detection circuit 45 or 46 is supplied to the control unit 16.

The operation of the forwarding/rewinding function and the indexing function will be explained in the followings.

When the rewinding button 41 is pushed down while the electronic speaking document viewer is outputting the synthesized speech, the speech synthesis is restarted from the top of the current passage while the typographic images is synchronized therewith on the character display 15. Namely, the detection circuit 45 serves to output the detection signal indicative of rewinding to the control unit 16, which then controls the electronic speaking document viewer to return to the top of the current sentence, i.e., to access to the semiconductor storage card 20 at the top address of the character string corresponding to the sentence being phonetically reproduced with the rewinding button 41 being pushed down.

Also, if the rewinding button 41 is pushed down when no synthesized speech is output from the electronic speaking document viewer, the speech synthesis is conducted from the sentence preceding to the latest sentence having been output as the speech while the typographic images is synchronized therewith on the character display 15. Namely, the control unit 16 serves to access to the semiconductor storage card 20 at the top address of the character string corresponding to the sentence.

Meanwhile, it is possible to determine the sentence to be reproduced in accordance with the repeat count of pushing down the rewinding button 41 or the time length for which the rewinding button 41 is maintained pushed down. When the forwarding button 42 is pushed down, the operation of the electronic speaking document viewer is conducted in the same manner as the case of the rewinding button 41 except for the direction.

In accordance with the present embodiment, the escape sequence is inserted to the positions of the intermediate language data corresponding to all the full stops of each page. For example, the escape sequence of 0x0000 is followed by the subsequent 8 bits indicative of the serial number of the escape sequence in the same line and the subsequent 16 bits indicative of the serial number of the line as counted from the top of the test data.

Next, the indexing function will be explained. The indexing function in accordance with the present embodiment is analogous to the action of underlining some letters in a page of a book, for the purpose of outputting only the typographic image or the synthesized speech relating to important part.

When the indexing button 43 is being pushed down, the typographic image and the synthesized speech reproduced during the period in which the indexing button 43 is pushed down are indexed. On the other hand, when the index reproducing button 44 is pushed down, the sentence having been indexed is displayed and speech synthesized.

Namely, the detection circuit 46 serves to detect the action of pushing down the indexing button 43 and transfer the detection signal to the control unit 16. The control unit 16 serves to store, in a register of the control unit 16, the address of the character string corresponding to the sentence phonetically and visually reproduced during the period in which the indexing button 43 is being pushed down. When the index reproducing button 44 is then pushed down, the control unit 16 serves to access to the semiconductor storage card 20 at the address as latched by said register.

In order to allow a plurality of indices, a plurality of such registers are provided in correspondence with the maximum number of indices so that one register is assigned anew each time indexing. A different repeat count of pushing down the index reproducing button 44 corresponding to each of the respective indices. Any index is independently selected by repeating pushing down the index reproducing button 44 for the repeat count corresponding to that index. Any indexed sentence as desired can therefore be reproduced at once to be displayed with the corresponding speech.

Meanwhile, the information of the indices as set in the title can be written into the semiconductor storage card 20. This function makes it possible to reproduce the semiconductor storage card 20 with indices by another compatible electronic speaking document viewer. Also, it is possible to transmit the intention (e.g., indication of emphasized passages) of one person to another person through the semiconductor storage card 20 with indices.

Furthermore, in accordance with the present invention, an analogous style with a real book is presented so that it may be needed to the so-called bookmark function for saving the position of the latest sentence which has been reproduced at the recent use of the electronic speaking document viewer. The user can resume the electronic speaking document viewer from that position without particular searching by means of the bookmark function. The bookmark function can be implemented as follows.

Usually, a register is used for latching a memory address which is used to access to the memory through an address bus. The content of register is saved, at power down of the electronic speaking document viewer, into for example a small amount of battery-powered CMOS memory provided for holding the date, time, and other necessary parameters. At power up, the electronic speaking document viewer is initialized to transfer the saved address to the register, calculate the top address of the latest displayed page and the top address of the latest sentence output as speech, and serves to display the latest page and start to phonetically output the next sentence.

[Third Embodiment]

Figure 7:
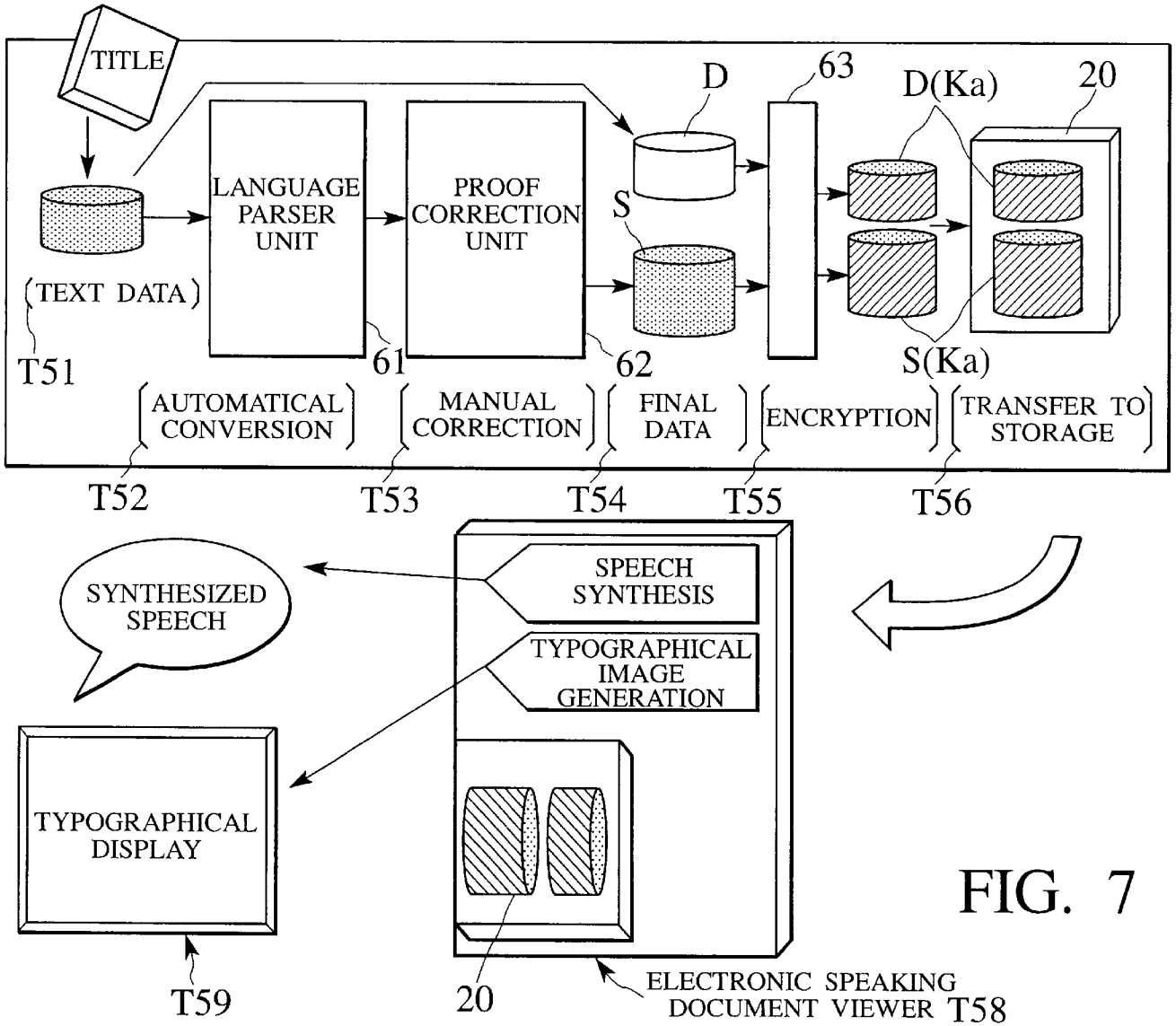
FIG. 7 is a block diagram showing the overall configuration of the authoring system for an electronic speaking document viewer in accordance with a third embodiment of the present invention.

FIG. 7 is a block diagram showing the overall configuration of the authoring system for an electronic speaking document viewer in accordance with the third embodiment of the present invention.

In the same figure, it is assumed that the text data D and the intermediate language data S is encrypted and stored in the semiconductor storage card 20 to distribute an electronic book as packaged for the electronic speaking document viewer in accordance with the first embodiment or the second embodiment of the present invention.

First of all, the title is converted to the text data (T51 in FIG. 7). A language parser unit 61 serves to automatically generate intermediate language data on the basis of the text data D (T52 in FIG. 7). Namely, the text data D is used for performing the phonetic parsing process, i.e., for extracting the rules of how to phonetically read the text content data with intonations and accents, articulation and so forth in order to generate the intermediate language data S.

The language parser unit 61 is an automatic conversion device having a learning function. The automatic conversion is gradually improved while increasing the sizes of dictionaries of the respective fields. However, since perfect conversion of 100% is impossible, a proof correction unit 62 is provided for manually correcting the automatic conversion in order to perfect the intermediate language data S (T53 in FIG. 7).

The data as obtained in this manner (T54 in FIG. 7), i.e., the text data D and the intermediate language data S as corrected is encrypted as explained with reference to FIG. 2 or FIG. 6 (T55 in FIG. 7) and stored in the semiconductor storage card 20 having the ID number A in the form of encrypted data D(ka) and S(Ka) (T56 in FIG. 7).

The contents data D(ka) and S(ka) as presented by the authoring system 60 is packaged in the semiconductor storage card 20 and reproduced by the electronic speaking document viewer in accordance with the first or second embodiment of the present invention in order to display the typographic images with the synthesized speech output through a loudspeaker or an earphone (T59 in FIG. 7). As explained heretofore, said text data D is not necessarily stored in the semiconductor storage card 20 as encrypted data D(ka).

In the case that the intermediate language data is not necessarily perfect as 100%, e.g., in the case of reports on newspaper, the proof correction unit 62 may therefore be dispensed with in such a case. However, it is necessary for comfortably and smoothly obtaining the speech to perfectly improve the quality as required of the intermediate language data so that the authoring system provided with the proof correction unit 62 for manually correction after automatically parsing by means of the language parser unit 61 becomes important.

While it may be the case that the intermediate language data is not necessarily perfect, the quality as required of the intermediate language data is required to be sufficiently high so that the authoring system provided with the proof correction unit 62 for manually correction becomes important.

[Fourth Embodiment]

FIG. 8 is a block diagram showing an exemplary service provider system serving to provide contents for use in the electronic speaking document viewer for converting text to speech sounds in accordance with a fourth embodiment of the present invention. As illustrated in FIG. 8, the service provider system in accordance with the fourth embodiment is composed of a computer network 71 which is open to the public such as the Internet, an information service site 73 of a service provider connected to the computer network 71, a computer terminal 83 of a user of the service connected to the computer network 71 through an internet provider 75. In FIG. 8, while the information service site 73 is illustrated as a lone site for the purpose of making clear the explanation, a number of similar information service sites 73 are connected to the computer network 71 in the actual case.

In this case, the computer network 71 is for example the Internet. The Internet is a global network that links smaller networks of computers by the use of the well defined TCP/IP protocol based upon packet communication. The computer network 71 can of course be implemented as another network. For example, the computer network 71 may be implemented as a satellite network or a wireless network.

The internet provider 75 is provided with routers which function as relay points on the network, gateways which connect computer networks that use different protocols, and so forth. The information service site 73 is provided with an information provider server 85 for exchanging information with the computer terminal 83, an information database 87 for storing information about services to be provided for the computer terminal 83 of the user. The information provider server 85 is implemented as a general purpose computer provided with a high capacity storage device. The high capacity storage device is for example a hard drive(s) or a magneto-optical disc(s). Of course, the hard drive or the magneto-optical disc may be located within or outside of the information provider server 85. The storage space of the high capacity storage device is partially assigned to the information database 87.

The information database 87 serves to store the text data D and the intermediate language data S prepared by the authoring system for the electronic speaking document viewer as illustrated in FIG. 7 in accordance with the third embodiment of the present invention. The text data D and the intermediate language data S has been stored in the information database 87 in the form of plane data, i.e., unencrypted.

In response to the request of the computer terminal 83, the information provider server 85 serves to transfer information of the information database 87 to the computer terminal 83. A unique address on the computer network 71 is given to the information provider server 85. The address is for example an IP address assigned to a computer(node) connected to the Internet. The information provider server 85 can be identified by means of the address on the computer network 71.

The semiconductor storage card 20 has been inserted to the computer terminal 83 of the user in advance. In the case that the computer terminal 83 of the user transfers a request for desired contents to the information provider server 85, the ID number A of the semiconductor storage card 20 is transferred to the information provider server 85 together with the information for identifying the particular contents. On the other hand, the information provider server 85 serves to receive the request of the computer terminal 83 of the user and encrypt the unencrypted text data D and the unencrypted intermediate language data S by the use of the ID number A of the semiconductor storage card 20 as explained above. An appropriate encryption program is therefore implemented in the information provider server 85.

Namely, the ID number A is read from the semiconductor storage card 20 and transferred to the information provider server 85, which then make use of the ID number A as a key or part of a key for generating the encryption key (ka). The original text content data D and the original intermediate language data S is then encrypted in the information provider server 85 with the encryption key (ka) in order to provide the encrypted content data D(ka) and the encrypted intermediate language data S(ka).

Then, the information provider server 85 serves to transfer the encrypted text data D and the encrypted intermediate language data S to the computer terminal 83 of the user. Alternatively, the information provider server 85 serves to receive the request of the computer terminal 83 of the user and encrypt only the unencrypted intermediate language data S by the use of the ID number A of the semiconductor storage card 20 as explained above. Then, the information provider server 85 serves to transfer the unencrypted text data D and the encrypted intermediate language data S to the computer terminal 83 of the user. In this case, of course, appropriate payment for the contents may be conducted, if desired, by a suitable procedure such as SET.

At least, the text data D and the intermediate language data S as downloaded can be transferred to the semiconductor storage card in the computer terminal 83 of the user. The semiconductor storage card is then extracted from the computer terminal 83 of the user and inserted to the electronic speaking document viewer in accordance with the first or the second embodiment of the present invention so that the text data D and the intermediate language data S is decrypted and reproduced.

In this case, even if the encrypted contents data D(ka) such as text data and the encrypted intermediate language data S(ka) is passed through the Internet, the ID number A is unique so that it is usually meaningless to pirate the copy.

Namely, it may be the case that the encrypted contents data D(ka) and the encrypted intermediate language data S(ka) can be transferred to the computer terminal of a user who would then transfer the copy to his semiconductor storage card without a license In this case, however, since an ID number B different than the ID number A is assigned to his semiconductor storage card, the encrypted contents data D(ka) and the encrypted intermediate language data S(ka) can not be decrypted with the decryption key (kb) and therefore it is impossible to reproduce the encrypted contents from his semiconductor storage card through the electronic speaking document viewer. As explained above, the electronic speaking document viewer serves to reproduce data only when the semiconductor storage card with the ID number B is storing the encrypted contents data D(kb) and the encrypted intermediate language data S(kb) as correspondingly encrypted with the ID number B.

As explained above in details, there are the advantages as follows in the case of the electronic speaking document viewer in accordance with the present invention.

(1) The text data consisting of character codes as read from the semiconductor storage card is converted to the synthesized speech by the speech synthesis to listen to the contents while, if desired, the typographic images are provided on a text data display unit. The electronic speaking document viewer can therefore be readily used for facilitating the comprehension of the contents.

(2) The synthesized speech data is generated from text data consisting of character codes and intermediate language data corresponding thereto so that the data size to be stored in the semiconductor storage card is significantly small as compared with the data size as required for storing raw speech data. A large amount of information can therefore be stored in a relatively small memory area as comparable with text data printed on paper. For this reason, the amount of information available in the form as described above is comparable with the amount of information given form text images printed on paper so that the electronic speaking document viewer can therefore be readily used.

(3) The speech synthesis can be performed with a high quality by the use of a semiconductor storage card in which is stored the intermediate language data which has been obtained by parsing the respective passages of the text data consisting of character codes and used for the speech synthesis. Furthermore, the intermediate language data occupies a smaller area in the memory space of the semiconductor storage card while there is no need for a language parser inside of the electronic speaking document viewer body. It is therefore possible to realize a compact and light weight electronic speaking document viewer at a reasonable low cost.

(4) The intermediate language data is stored in the semiconductor storage card together with the text data consisting of character codes, which are used for displaying typographic images on the text data display unit, so that there is no need for reversing the process of parsing the respective passages of the text data to the intermediate language data in order to obtain typographic images from the intermediate language data. It is therefore possible to realize a portable electronic speaking document viewer at a reasonable low cost.

(5) The intermediate language data, and alternatively the text data consisting of character codes, is encrypted and stored in a semiconductor storage card, which is then inserted to the electronic speaking document viewer for decrypting the encrypted data and reproduce the original contents. It is therefore possible to prevent the data stored in the semiconductor storage card from being pirated.

(6) The convenience of reading the text is improved by the provision of the forwarding/rewinding function and the indexing function.

(7) While the data of typographic images may include image data, the intermediate language data is generated by determining the rules of how to phonetically read the text content data as contained in the image data. Different genres such as funny pictures, cartoons, comic strips with dramatic stories can therefore be treated. The use of image data is applicable for any text data provided in the form of typographic images. The character codes as contained in the text data can be converted to the corresponding clear typographic images part of which may be expanded or part of which may include letters with an extraordinary appearance. It is possible to provide a variety of expressions of typographic images.

(8) It is possible to continuously use the electronic speaking document viewer for a long time since the load on the hardware thereof the electronic speaking document viewer is decreased by the use of the intermediate language data for performing the speech synthesis to lower the power consumption in order to meet with the conventional requirement of portable device for a long battery life.

Also, in the case of the authoring system in accordance with the present invention, the intermediate language data is manually rectified through the proof correction unit after automatically parsing by the use of the language parser unit resulting in the completed intermediate language data.

Furthermore, in the case of the semiconductor storage card in accordance with the present invention, the text data consisting of character codes and the intermediate language data is stored therein so that a large amount of information can therefore be stored in a relatively small memory area as compared with the case of storing raw speech data. Furthermore, it is possible to make compact and light-weight the electronic speaking document viewer not only because the semiconductor storage card itself is compact and light-weight but also because there is no need for mechanical parts in the electronic speaking document viewer for driving the semiconductor storage card unlike magnetic disks, optical disks and the like.

The foregoing description of preferred embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. An electronic speaking document viewer accommodating a semiconductor storage card in the form of a detachable card type storage medium in which text data consisting of letters and intermediate language data indicative of the rules of how to phonetically read said text data is stored, said electronic speaking document viewer comprising:

a text data display unit for displaying the text data consisting of letters stored in said semiconductor storage card;

a speech synthesis unit for performing speech synthesis on the basis of the intermediate language data stored in said semiconductor storage card;

a synthesized speech outputting unit for outputting the synthesized speech as synthesized by means of said speech synthesis unit; and a control unit for synchronizing said text data display unit and said synthesized speech outputting unit with each other, wherein signals indicative of forwarding and rewinding are detected; wherein when the signal indicative of forwarding is detected during the period in which said electronic speaking document viewer is outputting the synthesized speech, the sentence to be reproduced with synthesized speech is determined in accordance with the a repeat count of the forwarding signal in order to forward to the top of a sentence after the current sentence and to perform the speech synthesis; and wherein when the signal indicative of rewinding is detected during the period in which said electronic speaking document viewer is outputting the synthesized speech, the sentence to be reproduced with synthesized speech is determined in accordance with the repeat count of the rewinding signal in order to back up to the top of a sentence preceding the current sentence and to perform the speech synthesis.

2. The electronic speaking document viewer as claimed in claim 1 wherein said text data comprises image data and said intermediate language data is generated from typographic data contained in said text data to indicate the rules of how to phonetically read the typographic data.

3. The electronic speaking document viewer as claimed in claim 1 wherein said intermediate language data includes synchronization codes for synchronizing said text data display unit and said synthesized speech outputting unit with each other; and wherein said control unit serves to synchronize said text data display unit and said synthesized speech outputting unit with each other on the basis of the synchronization codes.

4. The electronic speaking document viewer as claimed in claim 1 wherein, when a signal indicative of indexing is detected during the period in which said electronic speaking document viewer is outputting the synthesized speech, an index is inserted to said text data and said intermediate language data at the location which is just phonetically reproduced when the indexing signal is detected and wherein, when a signal indicative of reproducing the indexed portion of said text data and said intermediate language data, the corresponding indexed data is reproduced.

5. The electronic speaking document viewer as claimed in claim 4 wherein when the signal indicative of reproducing the indexed portion is detected, said text data as indexed is displayed by said text data display unit while the speech synthesis is conducted by said speech synthesis unit with the intermediate language data corresponding to said text data as indexed.

6. The electronic speaking document viewer as claimed in claim 1 wherein the intermediate language data represents phonogramic data.

7. The electronic speaking document viewer as claimed in claim 6 wherein the phonogramic data of said intermediate language data consists of katakana character strings.

8. A semiconductor storage card comprising:

a non-volatile memory for storing unencrypted text data based on which typographic images are displayed by means of a typographic images displaying unit of an electronic viewer and for storing encrypted intermediate language data indicative of rules for how to phonetically read the text content data, wherein a speech synthesis is performed by means of a speech synthesis unit of the electronic viewer with reference to said unencrypted text data and said encrypted intermediate language data, wherein said non-volatile memory further comprises:

a first storage region for storing said text data;

a second storage region for storing said intermediate language data; and a third read only storage region for storing an ID number for identifying the semiconductor storage card itself, wherein said intermediate language data is encrypted by the use of the ID number; and a thin case for supporting said non-volatile memory.

9. An information provider server comprising:

an information database for storing text data consisting of letters and intermediate language data indicative of rules for how to phonetically read said text data in the form of unencrypted plain data; and an information provider server connected to said information database, wherein said information provider server comprises an encryption program, receives a request for said text data and said intermediate language data together with data for use in encryption through a network, encrypts said intermediate language data by the use of said data for use in encryption and sends a response accompanied by said intermediate language data as encrypted together with said text data through said network, wherein said data for use in encryption is an ID number of a semiconductor storage card in the form of a detachable card type storage medium in which said text data consisting of letters and said intermediate language data indicative of the rules of how to phonetically read said text data, and said data for use in encryption is used to generate an encryption key.

10. The information provider server as claimed in claim 9 wherein said text data is also encrypted by the use of said data for use in encryption and wherein said information provider server sends a response accompanied with said intermediate language data as encrypted together with said text data through said network.

11. The information provider server as claimed in claim 9 wherein said text data and said intermediate language data is such as decrypted and reproduced by an electronic speaking document viewer accommodating said semiconductor storage card, said electronic speaking document viewer comprising:

a text data display unit for displaying the text data consisting of letters stored in said semiconductor storage card;

a speech synthesis unit for performing speech synthesis on the basis of the intermediate language data stored in said semiconductor storage card;

a synthesized speech outputting unit for outputting the synthesized speech as synthesized by means of said speech synthesis unit; and a control unit for synchronizing said text data display unit and said synthesized speech outputting unit with each other.

* * * * *